US005469676A

United States Patent [19]

Colsman

[11] Patent Number: 5,469,676

[45] Date of Patent: Nov. 28, 1995

[54] MOTOR-VEHICLE PARKING SYSTEM

[75] Inventor: Alfred Colsman, Eurasburg, Germany

[73] Assignee: Round Palis AG, Rotkreuz, Switzerland

[21] Appl. No.: 171,465

[22] Filed: Dec. 22, 1993

[30] Foreign Application Priority Data

Dec. 29, 1992 [CH] Switzerland ..... 03 983/92

[51] Int. Cl.[6] ..... E04H 6/42

[52] U.S. Cl. ..... 52/174; 52/65; 52/30

[58] Field of Search ..... 52/30, 31, 32, 52/33, 64, 65, 174, 175

[56] References Cited

U.S. PATENT DOCUMENTS

| | | | |
|---|---|---|---|
| 2,849,127 | 8/1958 | Deusmore | 52/174 X |
| 3,079,871 | 3/1963 | Brodie | 52/174 X |
| 3,675,378 | 7/1972 | Neumann et al. | 52/174 X |
| 3,713,549 | 1/1973 | Routhier | 52/65 X |
| 3,873,085 | 3/1975 | Nakamura | 52/65 X |
| 5,090,862 | 2/1992 | Lee | 52/30 X |
| 5,113,974 | 5/1992 | Vayda | 52/65 X |

FOREIGN PATENT DOCUMENTS

| | | | |
|---|---|---|---|
| 0053478 | 4/1979 | Japan | 52/31 |
| 3047378 | 2/1991 | Japan | 52/174 |

*Primary Examiner*—Michael Safavi

*Assistant Examiner*—Winnie S. Yip

*Attorney, Agent, or Firm*—Browdy and Neimark

[57] ABSTRACT

The installation for the parking of motor vehicles has one or several autonomous parking units (S), shaped as sectors of a circle on plan. Each such unit has its own mechanical conveyor system, comprising a car lift (10) with a vertical guide (11) located in the region of the apex of the sector, and a cantilevered vehicle platform (12) that pivots across the angle enclosed by the sector. Within the parking unit (S) the lift (10) provides the vertical and horizontal transport of the vehicles between a drive-in/drive-out level (1) and the parking spaces on parking levels below and/or above level (1); in addition, the lift (10) is equipped for the radial transfer of vehicles. Each parking unit (S) also has its own means for turning vehicles in situ, e.g. one or several turntables or rotary platforms (8) at the drive-in/drive-out level (1). A vehicle-standing area (9) on each turntable or rotary platform can be turned to a drive-in position and a drive-out position and can be aligned radially with the vehicle platform (12) of the lift. A computer-controlled installation of this type is very flexible and readily adaptable to a wide range of operational situations. After being parked, the vehicles can be driven out and leave the parking installation readily without reversing. Because of its modular design, the system is suitable not only for use in buildings that are circular on plan, but also, always with similar units (S), for other layouts to conform to local circumstances.

20 Claims, 4 Drawing Sheets

MOTOR-VEHICLE PARKING SYSTEM

BACKGROUND OF THE INVENTION

The present invention relates to an installation for the parking of motor vehicles which comprises several drive-in and drive-out positions for vehicles, parking spaces (parking lots) arranged at several parking levels and forming a radial or star-shaped layout aligned upon a central axis, and automatically controlled mechanical conveyor means for the vertical and horizontal transport of the vehicles between the drive-in and drive-out positions and the parking spaces, and for the radial transfer of the vehicles.

PRIOR ART

Many proposals are known for mechanical parking systems which do not require the vehicle to be driven to a free parking place within the parking facility, either by ramps or other means of access, but where, instead, mechanical means take over the vehicle on arrival, park it automatically, and later return it to the waiting driver. In addition to parking garages constructed like automatic-stacker storage warehouses, whose parking spaces are arranged in parallel rows next to one another horizontally and above one another vertically, facilities of the aforesaid type and designed as circular parking garages are also known, wherein the parking spaces are grouped in a radial or star-shaped layout about an axis common to several parking levels located above one another.

One of the main requirements for mechanical parking garages is the speedy storage and retrieval of the vehicles, i.e. the user's waiting period should be kept as short as possible. Depending on location and the kind of use made of the parking garage, it is often necessary to provide for peak-hour operation, when large numbers of vehicles have to be accepted or handed back. But known types of tower- or silo-type facilities hardly ever meet this important requirement. Thus, for example, in the mechanical parking-tower system described in DE-A-40 11 088, a single drive-in/drive-out position receives arriving vehicles on a stack of pallets; a lift then takes the vehicle with the topmost pallet, transports it vertically in a central lift shaft, and rotates it in position relative to the tower's diameter about its own axis in order to reach a location in front of a free parking lot, where it is then stored with the pallet.

Another proposal (DE-P-1 531 991 or DE-P-1 684 724) provides for a spiral tower-like structure of vehicle parking lots stacked next to one another as in a spiral staircase. A car lift, also aligned upon the shaft diameter, moves in a helical line up and down the structure's central shaft. Again, DE-P-23 15 648 describes a system of the above mentioned type, having several drive-in and drive-out points and several feeder units that can move along a closed circular path about a common axis. Whereas all these units can move to any of the storage positions, their paths must cross each other so that their mobility and availability are severely limited.

A further disadvantage of known systems of this kind is that, in order to leave, the driver must reverse the vehicle out of the facility; this is awkward, wastes time, and seriously inhibits traffic flow. Finally, the systems known from prior art referred to above, and the conveyor means they use, must necessarily be built as circular structures. This also places considerable limits on the planning and construction of such facilities, because it is not always possible to achieve a satisfactory design for an essentially circular shape of structure on a given site, whether in terms of its architectural, its economic, or its traffic-engineering aspects.

SUMMARY OF THE INVENTION

The principal object of the present invention is to propose a vehicle-parking system of the aforesaid type which however makes it possible to overcome the disadvantages inherent in prior art. In particular, it seeks for high-frequency storage and retrieval of the vehicles, i.e. keeping within reasonable limits the waiting time spent by users even in peak-hour operational conditions. Similarly, it seeks to achieve wide planning or layout flexibility, to allow installations of this kind to be built on both large and small sites, and to make them suitable for a wide range of architectural and constructional conditions.

With the present invention, these and other objectives are achieved in accordance with the characterising features set forth in patent claim 1. Hence, at least one autonomous parking unit is provided, the ground plan of which is shaped as a sector of a circle and each unit having its own associated car lift. The car lift in each unit has a vertical guide in the sector's apex area, and a vehicle platform which cantilevers from the guide and pivots laterally across the whole of the angle formed by the sector. It also provides in each parking unit for means of turning each vehicle in situ.

The invention makes it possible therefore to use one or more such autonomous units to make up different layouts and sizes of installation, in order to provide the required capacity for any given site and to suit its particular architectural, structural, traffic, and operational circumstances. At the same time, it allows great flexibility as regards the planning, operation, and and availability (operational reliability) of the facility. The system's modular design more than compensates for an apparently higher mechanical content involved in the provision of a separate car lift for each autonomous parking unit. Furthermore, it achieves substantial benefits in the servicing and maintenance of such facilities, particularly in the design and provision of automatic control systems.

Other feasible and special embodiments of the invention as set forth in claim 1 are the subject of dependent claims 2 to 11.

Various embodiments of the invention are described below in greater detail, by reference to and in conjunction with the drawings, as follows:

DETAILED DESCRIPTION OF INVENTION

Figure 1:
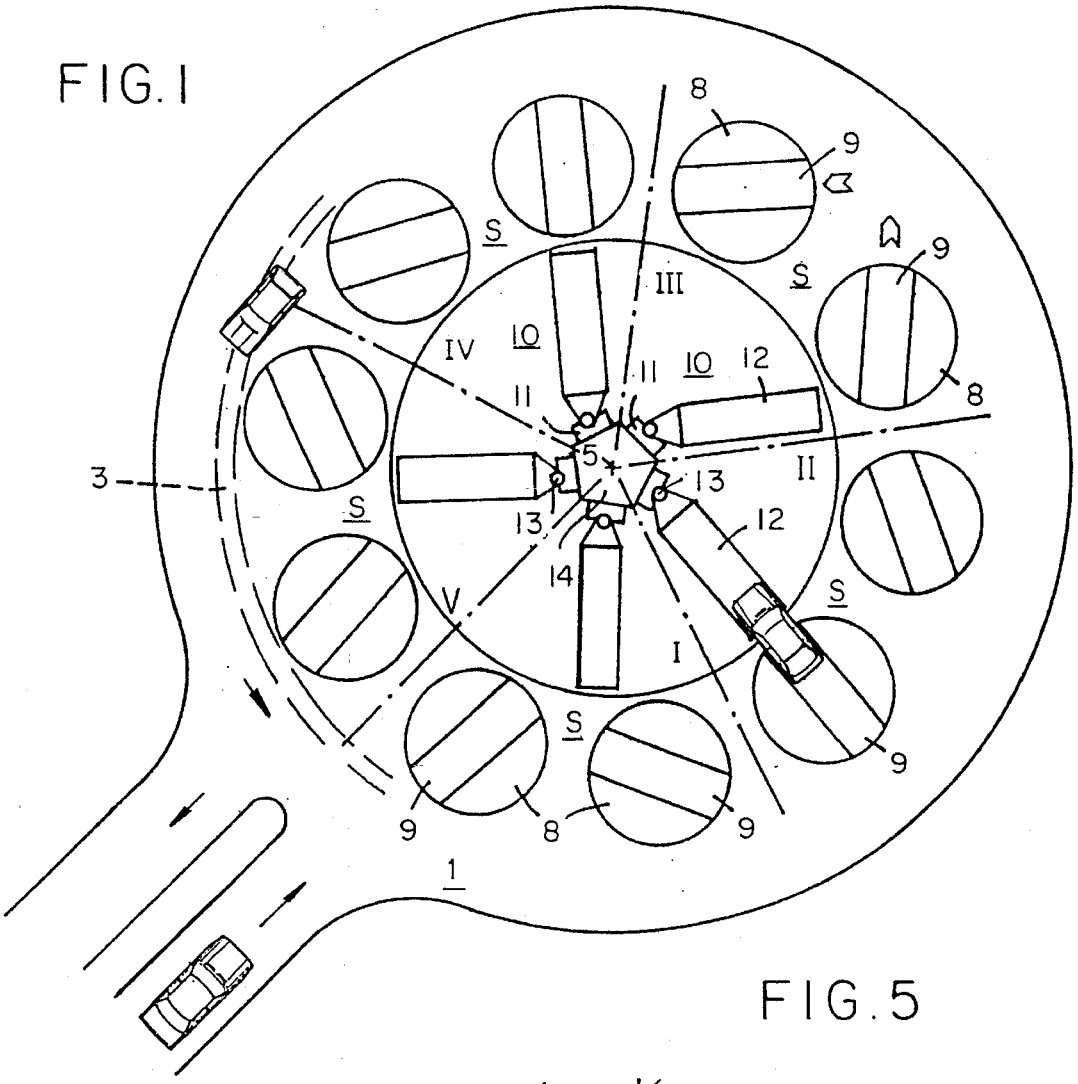
FIG. 1 is a plan view of the drive-in/drive-out level of a parking installation made up of five autonomous parking units S and designed as a circular parking garage.
Figure 2:
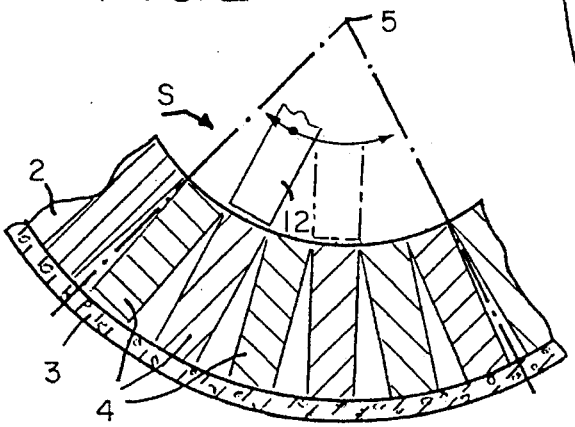
FIG. 2 is a diagrammatic plan view of one of the parking levels in a single parking unit or sector of the installation in accordance with FIG. 1.
Figure 3:
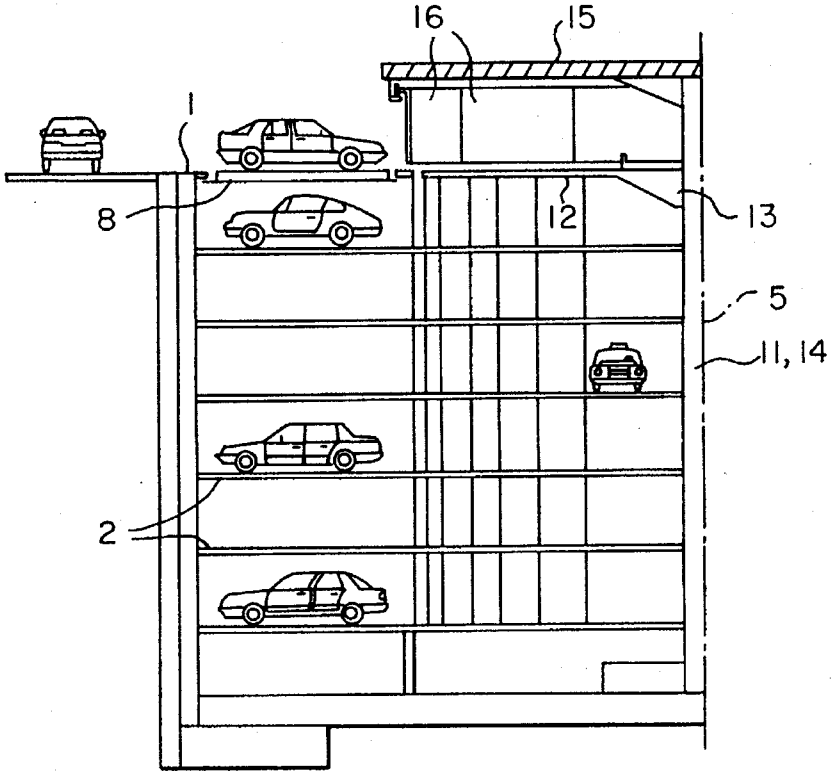
FIG. 3 is a vertical section through one of the parking units of the installation according to FIG. 1.

The first embodiment of a vehicle-parking installation as shown in FIGS. 1 to 3 is designed as a circular building with a central vertical axis 5. Several parking levels 2 (FIG. 3) share a single drive-in and drive-out level 1 and may be either below said level 1 or, in the case of a building construction above ground, above it. The parking levels 2 extend from a circular peripheral wall 3, and each such parking level 2 has several parking spaces or parking lots 4 (FIG. 2) aligned at least approximately radially upon the central axis 5. Radially inward from the parking spaces 4 is a shaft that houses the installation's mechanical conveyor system, described in greater detail below. The conveyor system is controlled automatically and provides for the vertical and horizontal transport of the vehicles within the installation, i.e. between the drive-in and drive-out points at level 1 and the parking spaces 4 at levels 2, and for the radial transfer of the vehicles at all these levels. At level 1, a roundabout traffic system permits the vehicles that arrive for parking to drive in and those that leave the installation after being parked to drive out.

In the embodiment shown, the installation consists of five essentially identical autonomous parking units S. On plan, each unit S is shaped as a sector of a circle, the sector angle thus being 72° in the present embodiment. The geometrical limits of each unit S, numbered I to V in FIG. 1, are shown by dot-dashed lines, but they need not be particularly apparent either structurally or visually. The five units S fit together next to one another on plan so that the apexes of all the sectors lie on their common axis 5.

Each autonomous parking unit has its own car lift 10, comprising a vertical guide 11 positioned in the area of the sector's apex (such as running rails, a column guide, a telescopic column, or similar); the car lift 10 further comprises a vehicle platform 12 that cantilevers from the vertical guide 11 and can be raised, lowered, and pivoted laterally across the whole of the sector angle, as indicated diagrammatically by the pivot axis 13. Preferably the vertical guides 11 of all the car lifts 10 in the parking installation are attached or combined to a common central column 14. The vehicle platform 12 of each car lift 10 can move to any level 1 and 2, and at the parking levels 2 it can be aligned with each of that level's parking spaces 4 located next to one another in that sector. Each sector in the embodiment shown has six parking levels 2 and six parking spaces 4 next to one another; each car lift thus serves 36 parking lots in its parking unit S. A particularly suitable embodiment of a car lift 10 is described in greater detail below, by reference to FIGS. 8 and 9.

Each car lift's vehicle platform 12 has a so-called transfer mechanism (not shown in detail). This mechanism effects the radial transfer of vehicles, both at the parking levels 2 between the platform 12 and the parking spaces 4, and at level 1 for the reception and return of the vehicles. For example, the transfer mechanism may be a kind of extensible and retractable telescopic tongue that can roll on the platform 12 and the level that lies radially beyond it, and slightly raises the vehicle above its normal support to transfer it from the platform 12 to the parking space 4 and vice versa. The transfer mechanism may be similar, at least partly, to a type already known from prior art, such as disclosed in DE-A-20 02 867 or in DE-A-23 15 648.

Further, each automomous parking unit S has means for turning a vehicle in situ. For example, at traffic level 1, the installation shown in FIGS. 1 to 3 has two turntables or rotary platforms 8 in each sector for this purpose. Each of these turntables 8 has a vehicle-standing area 9 and is rotatable, preferably through 360° by means of a rotating mechanism (not shown)

Figure 4A:
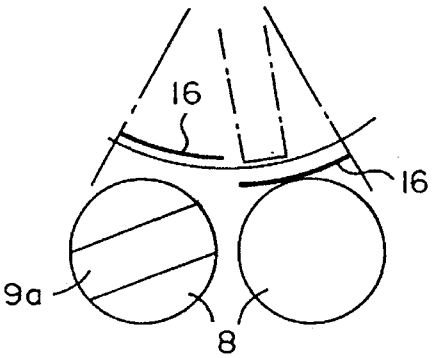
FIG. 4 is a diagrammatric drawing of three different operational stages (a, b, c) in the drive-in/drive-out area of an autonomous parking unit.
Figure 4B:
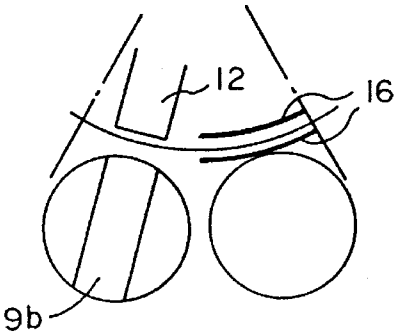
Figure 4C:
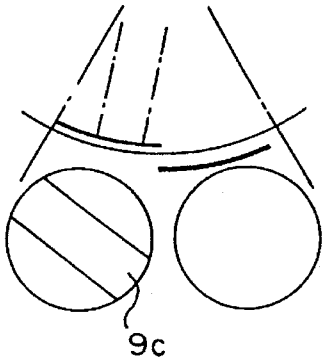

FIG. 4 shows various rotational positions of the left-hand turntable or rotary platform 8 in one sector. In FIG. 4*a* the turntable's vehicle-standing area is in the drive-in position 9*a*; in the roundabout traffic assumed in accordance with FIG. 1, this position is convenient for driving a vehicle for parking to the turntable's vehicle-standing area. In FIG. 4*c* the same standing area is in the drive-out position 9*c*; and in FIG. 4*b* the standing area 9*b* is aligned radially with the correspondingly pivoted vehicle platform 12 of the car lift, i.e. the turntable's standing area 9 is aligned radially with the pivot axis 13 and thus approximately with the sector's apex. The drive-in and drive-out positions of the turntable 8 and its standing area 9 depend on the turntable's position in relation to the parking facility's periphery, and may thus differ from those shown in FIGS. 4*a* and 4*c*; for example, FIG. 1 shows the standing area of the first turntable or rotary platform 8 in sector I in the drive-in position, and the last standing area in sector V in the the drive-out position. In other words, the vehicle-standing area of every turntable or rotary platform in the installation can be selected and oriented as convenient, and its position can be preset and programmed, for example as shown by positions 9*a*, 9*b*, and 9*c* referred to above.

In the typical situation shown in FIG. 1, if a signal indicates a free parking space in a given parking unit S, a driver who wants to park his car can drive directly to the standing area 9 of the first turntable 8 in sector I, or may continue to drive it counterclockwise to the next standing area oriented in the drive-in position, for example to that of the second turntable in sector II, etc. In sector IV, the standing area of the second turntable is shown in the drive-out position and a departing vehicle has just left it. The standing areas 9 of other turntables 8 are shown in the drive-out position, as necessary, after the corresponding vehicle platform 12 has supplied a vehicle to them ready for departure. Conversely, on the first turntable or rotary platform in sector II, a vehicle for parking is shown in the process of being transferred from the standing area 9 to the lift's vehicle platform 12. On the other hand, the first turntable or rotary platform in sector IV could, for example, be used in that position for a transfer in the opposite direction, i.e. for the dispatch of a vehicle from the vehicle platform 12 to the turntable.

Generally, a complete parking cycle presents itself as follows: An arriving driver drives in the roundabout lane to the first free standing area 9 that happens to be in the drive-in position. He leaves the vehicle, locks it, and takes a ticket from a parking-ticket dispenser (not shown) that prints and encodes all necessary data on the ticket. The driver then leaves the parking garage on foot. The turntable on which the vehicle stands turns it to align radially and the vehicle platform 12 moves opposite it. The lift takes over the vehicle, moves opposite the nearest free parking space in the parking unit, and transfers the vehicle radially to that space. When the driver returns to retrieve the vehicle, he inserts his ticket in a pay automat and pays the parking fee it displays. The automat indicates the turntable that will dispatch the vehicle. The lift 10 retrieves the vehicle from its parking space and transfers it to the turntable, which then moves to its drive-out position.

The turntable should preferably turn the vehicle as it is being parked, before transfer to the lift, so that the back of the vehicle points to the sector's apex. While the vehicle is in the installation, it remains in this position until it returns to the turntable after retrieval. However, it is also feasible to turn the vehicle after retrieval. In either case, the driver unlocks the vehicle, gets in, and can leave the facility without having to reverse the car.

The movements of turntables and car lifts described above are all automated and computer-controlled independently for each parking unit; they are run by suitable programs and depend on signals from appropriate position transmitters, monitoring elements, and sensors. The positioning movements of the turntables and the transport movements of their car lifts can generally be simultaneous and independent of one another, except that they must of course be mutually coordinated for transfer at level 1. Similarly, each lift can pivot its platform 12 laterally at the same time as it travels up or down.

Because the system described in the present disclosure is extremely flexible, it is readily adaptable to a wide range of operational conditions, particularly when large numbers of vehicles have to be parked (always provided, of course, that there are no free parking lots available) or when large numbers of vehicles have to be retrieved at approximately the same time. Moreover, an installation of this type offers a high level of operational reliability. For example, if any part of one of the parking units S, such as the car lift, temporarily fails, it does not affect the other units, which can continue working normally. To allow retrieval of vehicles in a parking unit affected by a more serious breakdown e.g. of a car lift that cannot be dealt with quickly, it may also be desirable to make the central column 14 (FIG. 1), to which the vertical guides 11 are attached, capable of rotating about their common vertical axis 5. In an emergency this would make it possible exceptionally to rotate the column and thereby to move the car lift 10 of one of the adjacent parking units temporarily to the sector where the breakdown has occurred, in order to deal with the vehicles parked there.

A safety device to protect the installation's users is described below by reference to FIGS. 3 and 4; this device normally prevents access at level 1 to the central shaft occupied by the car lifts. For this purpose, separating walls or partitions 16 (not shown in FIG. 1) are provided next to the turntables 8 to close the aforesaid shaft, and can be moved across the angle of the sector. For example, the partitions 16 may run or slide laterally on circular horizontal rails, guides, or tracks attached to a roof structure 15 that covers the shaft. A pair of such partitions 16 covers the angle of each sector and normally keeps the shaft closed (FIG. 4*a*, 4*c*). Only for the transfer of a vehicle at level 1, one of these walls or partitions 16 slides laterally in front of or behind the other partition (FIG. 4*b*) and after transfer immediately slides back to the closed position.

The five parking units S of the typical parking installation shown in FIG. 1 form a complete circle on plan. However, this is not an absolute necessity; the sectors of another facility may also be placed next to one another, but the number of sectors and/or the angle enclosed by each sector may be different, and the area on plan may form only part of a circle, say a semicircle or three-quarters of a circle. To suit local circumstances, other facilities that make use of the vehicle-parking system according to the invention may have a completely different type of layout.

Figure 5:
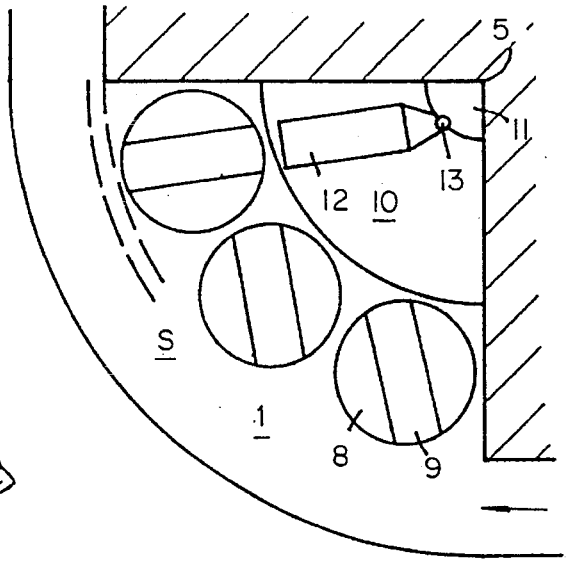
FIG. 5 is a plan view of the drive-in/drive-out level in another installation designed as a single autonomous unit.

FIG. 5 shows an installation that consists of only a single parking unit S. As indicated, such an installation may, for example, make use of a corner site at the bend of a road, to fill the internal angle formed by two buildings. In the example shown, the angle at the sector's apex 5 is 90°, and three turntables 8 are provided within this angle. In all other respects this parking unit S is similar in design to that described above, and the mechanical units that can be used are essentially identical.

Figure 6:
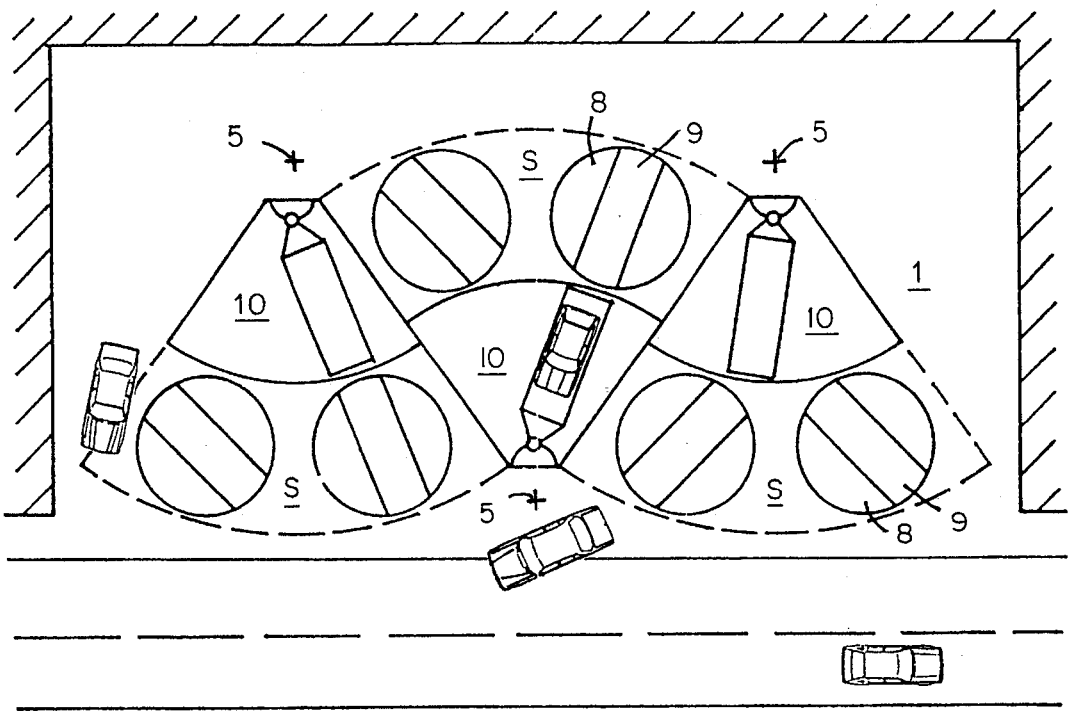
FIG. 6 is a plan view of a further typical installation made up of three identical parking units S, as in the example shown in FIGS. 1 to 3, however in a different layout.

FIG. 6 shows another possible layout, in which three autonomous parking units S are placed next to one another, for example in a gap or a recess in a building or between buildings; the sides of the sectors touch, but in this case the position of the sectors' apexes 5 alternates, i.e. alternate sectors are turned through 180°. Obviously, any other number of sectors or units S could be used, and the sector angle may differ from that shown in FIG. 6, so that the plan of the entire facility can fit any given shape and size of site, traffic conditions, and required number of parking spaces. In addition, it is possible to drive all round the facility shown in FIG. 6, so that all the autonomous parking units are equally accessible.

Figure 7:
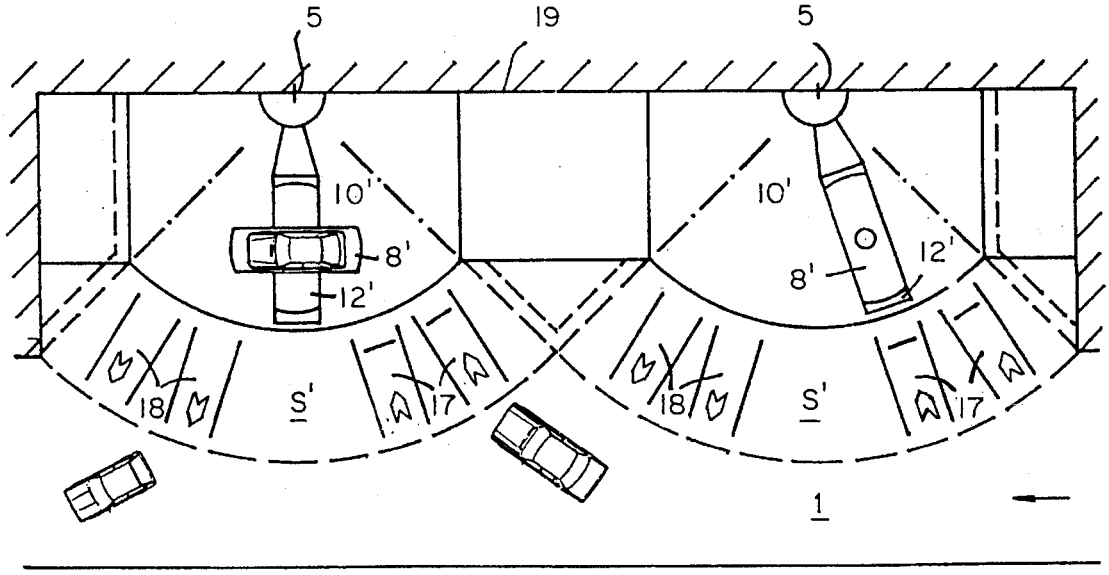
FIG. 7 is a plan view of yet another embodiment of installation according to the invention, but made up of a slightly different design of autonomous parking units S'.

In a further typical installation, as shown in FIG. 7, two or more identical parking units S' are set next to each other in such a manner as to place the apexes 5 of the sectors in a straight line 19. Such a layout could, for example, make use of a relatively shallow horizontal recess or gap in a building or between buildings, say in a one-way street. Compared with the examples described above, this embodiment is different in one particular respect: at drive-in/drive-out level 1, there are no turntables; instead, each sector has, for example, two permanently fixed drive-in positions 17 and two drive-out positions 18 marked on the floor. The fixed orientation of these positions is appropriate to the prescribed direction of one-way traffic. To turn the vehicles through 180° during parking or retrieval, the vehicle platform 12' of the car lift 10' in each parking unit S' has a rotary platform 8'. The alternative features shown in FIG. 7 can, of course, also be used in any other type of layout, but operating cycles tend to be slightly longer for this version, because the car lift 10' also has to turn the vehicle on the turntable platform 12' as it travels up or down and pivots to align with a free parking space.

Figure 8:
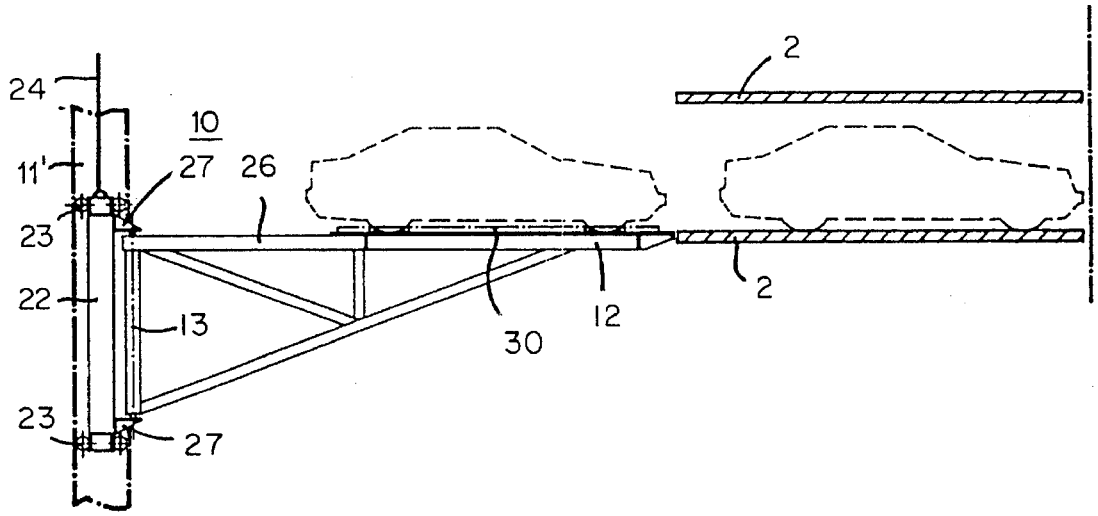
FIG. 8 is a side elevation of a preferred embodiment of a car lift, with the parking levels shown in section.
Figure 9:
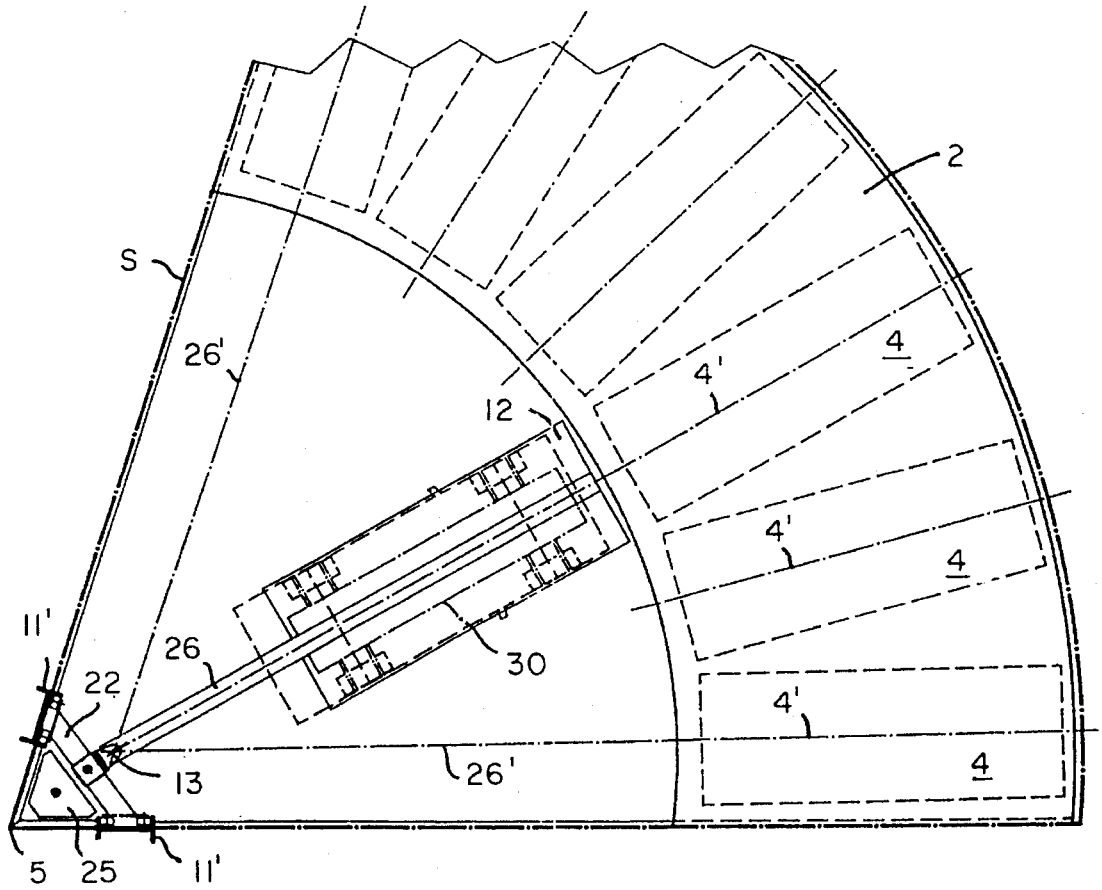
FIG. 9 is the related plan view of the sector-shaped parking unit, looking down on the car lift in accordance with FIG. 8.

A preferred embodiment of the car lift 10 is described now in greater detail by reference to FIGS. 8 and 9. For this purpose, the reference numbers of the main components are the same as those used above. FIG. 9 shows a pair of permanently fixed guide rails 11' in the apex area of the sector. A frame-shaped carriage 22 fitted with runners 23 is guided between these profiles and can be raised and lowered. As indicated, the vertical movement may be controlled by a cable 24 attached to the carriage 22, which is guided from above by a driving roller (not shown) and whose weight is balanced by a counterweight 25. A cantilever arm 26 is attached to the carriage and can be pivoted about its vertical axis 13 which is defined by upper and lower pivot pins and bearings 27. The cantilever arm can pivot between the two end positions 26' shown by dot-dashed lines and can be aligned with the centre-line 4' of each parking space 4. To control the pivot movement, it is possible to use a linear drive (not shown) that acts between the carriage 22 and the cantilever arm 26 or, for example, a gear drive or a toothed-belt drive that acts directly upon the pivot axis.

The vehicle platform 12 is permanently fixed to the cantilever arm 26. A radial transfer mechanism 30, referred to above and indicated here by a dot-dashed line, fits on top of the platform. When, as shown, the platform 12 of the lift is level with a parking space 2, the mechanism 30 can be extended and retracted radially, in order either to move a vehicle that stands on the platform 12 to a parking space 4 or, conversely, to retrieve a vehicle parked in a parking space 4 and return it to the platform 12; as stated above, the procedure at the drive-in/drive-out level 1 in connection with the turntables 8 is similar. During radial transfer of a vehicle it may be desirable to provide for mechanically locking the cantilever arm or the vehicle platform to the parking level opposite.

I claim:

1. Installation for parking of a motor vehicle, comprising a drive-in and drive-out level, a plurality of parking levels vertically spaced separate from the drive-in and drive-out level, at least one parking unit (S, S') at the drive-in and drive-out level having at least one drive-in and drive-out position (9, 17, 18) for the vehicle, each said drive-in and drive-out position having turntable means for turning the vehicle in situ in relation to the drive-in and drive-out position, a ground plan of said parking unit having a form of a sector of a circle, a plurality of parking spaces (4) on said parking levels (2) separate from the parking unit (S, S'), said parking spaces aligned side by side radially on an arc of a circle, at least one automatically controlled mechanical car lift means (10, 10') for vertical and horizontal transport of the vehicle between the drive-in and drive-out position (9, 17, 18) and the parking spaces (4), the car lift means (10, 10') having a vertical guide (11) located adjacent to an apex of, and within the sector of the parking unit, each said parking unit (S, S') being served by one of said car lift means (10, 10')

said car lift means further having vehicle platform means (12, 12') cantilevered from said vertical guide for pivoting laterally across an angle within the sector of the parking unit associated and aligned with said turntable means and respectively retrieving the vehicle from a drive-in position of said drive-in and drive-out position and depositing the vehicle on one of said parking spaces at one of said parking levers and thereafter respectively retrieving the vehicle from said parking space of said parking levels and depositing the vehicle on the drive-out position of said drive-in and drive-out position, wherein an operator can respectively leave or retrieve the vehicle on the drive-in position of the drive-in and drive-out position, or the drive-out position of the drive-in and drive-out position and, said car lift means will thereafter move the vehicle between the drive-in position or the drive-out position and the parking spaces.

2. An installation according to claim 1 wherein said turnable means for turning the vehicle in situ comprises a rotary platform (8) on said drive-in and drive-out position, said rotary platform having a vehicle-standing area (9) which can be oriented as required to a drive-in position (9*a*), a drive-out position (9*c*), or to radial alignment (9*b*) with the vehicle platform means (12).

3. An installation according to claim 1, wherein said turnable means for turning the vehicle in situ comprises a rotary platform (8') on the vehicle platform means (12') and said drive-in and drive-out position comprises a fixed drive-in position (17) and fixed drive-out position (18) within the sector of the parking unit at the drive-in/drive-out level (1).

4. An installation according to claim 1 further comprising a movable partition wall (16) provided adjacent the drive-in and drive-out position for preventing access to the car lift (10, 10').

5. An installation according to claim 1, wherein the car lift (10, 10') comprises a carriage (22) which can be raised or lowered along said vertical guide (11, 11'), and to which a cantilever arm (26) is journalled for pivoting about a vertical pivot axis (13).

6. An installation according to claim 1, wherein several of said parking units (S, S') are placed net to one another, with the apex of each sector coinciding at a common point.

7. An installation according to claim 6, wherein said several of said parking units form a full circle in a plan view.

8. An installation according to claim 6, wherein each vertical guide of said corresponding car lift (10, 10') is arranged about a central column (14) which can be rotated about a common axis (5) through said common point.

9. An installation according to claim 1, wherein several of said parking units (S, S') are placed in a line next to one another with sides abutting, but with each apex of the sector of the parking unit alternately on opposite sides of said line.

10. An installation according to claim 1, wherein several of said parking units (S, S') are placed in a line next to one another with each apex of the sector of the parking unit positioned on said line.

11. An installation according to claim 1, comprising of a single parking unit (S, S') where the sector has an angle of approximately 90°.

12. An installation according to claim 2 further comprising a movable partition wall (16) provided adjacent the drive-in and drive-out position for preventing access to the car lift (10, 10').

13. An installation according to claim 3 further comprising a movable partition wall (16) provided adjacent the drive-in and drive-out position for preventing access to the car lift (10, 10').

14. An installation according to claim 13, wherein the car lift (10,10') comprises a carriage (22) which can be raised or lowered along said vertical guide (11, 11'), and to which a cantilever arm (26) is journalled for pivoting about a vertical pivot axis (13).

15. An installation according to claim 14, wherein several of said parking units (S, S') are placed in a line next to one another with sides abutting, but with each apex of the sector of the parking unit alternately on opposite sides of said line.

16. An installation according to claim 14, wherein several of said parking units (S, S') are placed in a line next to one another with each apex of the sector of the parking unit positioned on said line.

17. An installation according to claim 16, comprising of a single parking unit (S, S') where the sector has an angle of approximately 90°.

18. An installation according to claim 12, wherein several of said parking units (S, S') are placed in a line next to one another with sides abutting, but with each apex of the sector of the parking unit alternately on opposite sides of said line.

19. An installation according to claim 12, wherein several of said parking units (S, S') are placed in a line next to one another with each apex of the sector of the parking unit positioned on said line.

20. An installation according to claim 12 comprising of a single parking unit (S, S') where the sector has an angle of approximately 90°.

* * * * *